US006989534B2

(12) United States Patent
Schubert et al.

(10) Patent No.: US 6,989,534 B2
(45) Date of Patent: Jan. 24, 2006

(54) METHOD AND DEVICE FOR THE CAPTURE OF IONS IN QUADRUPOLE ION TRAPS

(75) Inventors: Michael Schubert, Bremen (DE); Jochen Franzen, Bremen (DE)

(73) Assignee: Bruker Daltonik GmbH (DE)

( * ) Notice: Subject to any disclaimer, the term of this patent is extended or adjusted under 35 U.S.C. 154(b) by 128 days.

(21) Appl. No.: 10/849,499

(22) Filed: May 19, 2004

(65) Prior Publication Data

US 2005/0023461 A1 Feb. 3, 2005

(30) Foreign Application Priority Data

Jun. 5, 2003 (DE) ..... 103 25 581

(51) Int. Cl.
*H01J 49/42* (2006.01)

(52) U.S. Cl. ..... 250/292

(58) Field of Classification Search ..... 250/292, 250/290, 281, 282

See application file for complete search history.

(56) References Cited

U.S. PATENT DOCUMENTS

| | | | | |
|---|---|---|---|---|
| 5,420,425 A | | 5/1995 | Bier et al. | |
| 5,572,035 A | | 11/1996 | Franzen | |
| 5,739,530 A | | 4/1998 | Franzen et al. | |
| 5,818,055 A | * | 10/1998 | Franzen | 250/292 |
| 6,316,769 B2 | | 11/2001 | Takada et al. | |
| 2002/0074492 A1 | | 6/2002 | Taniguchi | |

FOREIGN PATENT DOCUMENTS

| | | |
|---|---|---|
| DE | 1 698 216 D T | 3/1968 |
| DE | 195 23 859 A1 | 6/1995 |
| DE | 100 58 706 C1 | 11/2000 |
| FR | 2 521 778 A1 | 8/1983 |
| GB | 2 315 364 A | 1/1998 |
| GB | 0412403.8 | 11/2004 |
| WO | WO 98/02901 A1 | 1/1998 |
| WO | WO 98/05039 A1 | 2/1998 |
| WO | WO 01/29875 A2 | 4/2001 |

OTHER PUBLICATIONS

Hager, James W., et al., "A new linear ion trap mass spectrometer", Rapid Communications In Mass Spectrometer, vol. 16, John Wiley & Sons, Ltd., 2002, pp. 512–526.

* cited by examiner

*Primary Examiner*—Kiet T. Nguyen

(57) ABSTRACT

The invention relates to methods and devices for the effective capturing of externally generated ions in an RF operated quadrupole ion trap. The invention involves applying a voltage consisting of positive and negative pulses, instead of a sinusoidal RF voltage, during the capturing process, with capturing intervals between each pulse in which the voltage is low.

12 Claims, 4 Drawing Sheets

METHOD AND DEVICE FOR THE CAPTURE OF IONS IN QUADRUPOLE ION TRAPS

FIELD OF THE INVENTION

The invention relates to methods and devices for the effective capturing of externally generated ions in an RF operated quadrupole ion trap.

BACKGROUND OF THE INVENTION

For mass spectrometric methods in biochemistry, in particular in genetic and protein research, the amount of substance used by these methods is a decisive factor. In order to obtain a mass spectrum from a few attomols of a substance (1 attomol=600,000 molecules), it is necessary to maximize the ion yield of the ionization process and to minimize the ion losses at all stages from ion generation to ion measurement. The yield of every stage must be optimized.

When RF quadrupole ion traps are used as mass spectrometers, the process of capturing externally generated ions in the ion trap usually results in a widely unsatisfactory yield. Hitherto only three to five percent of the ions being continuously produced are trapped, the remainder is usually lost.

The intermediate storage of the ions in an RF ion guide already represents a great improvement as far as the optimization process is concerned. It is thus possible to temporarily store ions from a continuously operating ion source in such a way that the quadrupole ion trap is only loaded with ions during a relatively short filling time. During the protracted analysis time, on the other hand, the ions are temporarily stored and thus collected. In particular, the ions in the RF ion guide can be decelerated to thermal energies ("thermalized"), thus improving the capturing process in the quadrupole ion trap. The RF ion guide consists usually of a system of parallel rods, arranged on a virtual cylinder, to which the two phases of an RF voltage are alternately applied. Quadrupole, hexapole and octopole systems have proven successful for this. It is also possible to use other types of RF ion guides such as double helices or ring systems to which an RF is applied.

However, even with this intermediate storage of ions, the yield of the capturing process of the ions which are injected into the quadrupole ion trap is still unsatisfactory.

At present, there is still relatively little known about the mechanism by which ions are captured in the quadrupole ion trap. Research, encompassing experiments on ion traps as well as computer simulations, has shown that ions can only be trapped in an extremely short phase interval of a few percent of the complete RF period. The length of the capturing interval is strongly dependent on the injection energy of the ions and weakly dependent on the pressure of the collision gas in the ion trap. In the remaining phases of the RF period (outside the phase interval in which the ions can be captured), the ions may be reflected at the entrance to the quadrupole ion trap ("reflection interval"), because they encounter an opposing strong high-voltage field inside the ion trap. Otherwise, they experience an accelerating suction field ("transverse interval"), are accelerated in the ion trap towards the end cap opposite the entrance, traverse the ion trap without being sufficiently decelerated and strike the end cap. They are lost for further use by being discharged at the end cap. Depending on the strength of the momentary suction field at the entrance, i.e., on the phase of the RF voltage, the traversing process may take place in less than one RF period, but it also may take around ten to twenty RF cycles. If the traversing process is slower than that, the collision gas decelerates the ions, and capturing will be achieved. The operating pressure of damping gas which is favorable for the operation of quadrupole ion traps (usually helium or nitrogen) has free path lengths of the order of magnitude of one ion trap diameter in the injection direction, and is therefore not sufficient to decelerate ions during their first traverse.

U.S. Pat. No. 5,739,530 describes how the ion yield can be improved by forming packets of ions for the injection by means of a switchable ion lens. The ions are then injected in individual packages at the phase interval favorable for capture. With the extremely short capturing interval which usually prevails, this method, however, fails because the mass-dependent flight velocities in the injection lens mean that only ions within a narrow mass range can be injected for capture in the short interval. It has not yet proved possible to really use the basic idea of this patent and, despite intense efforts, the yield of the capturing process for ions injected into the quadrupole ion trap has not exceeded five to ten percent of the available ions up to now.

SUMMARY OF THE INVENTION

The invention makes use of the fact that it is not necessary to maintain a sine shape for the RF voltage in order to store the ions in an RF ion trap. The basic idea of the invention is to use a special shape of RF voltage during the storage process. The RF voltage applied during the storage process should contain relatively long intervals of low capturing voltage in its period, thus enabling low energy ions to penetrate deeply into the storage cell and to stop there. This considerably extends the capturing interval.

The intervals of low capturing voltage may show permanently zero voltage, or alternately, there can be some low voltages whose weak electric fields in the ion trap are favorable for the deceleration or acceleration of the ions, as far as their capturing is concerned. The voltages in this interval can, for example, initially form a slight opposing field which reduces the injection velocity of the ions until they practically come to rest. Here, one must make allowance for the fact that the opposing residual field decreases linearly towards the center of the ion trap, i.e., it becomes weaker, the further the ions penetrate. In the course of this low voltage interval, the opposing voltage can then decrease in order to make it possible for the ions now coming to penetrate relatively deeply into the ion trap without a decelerating field.

Another possibility is that the ions initially see a weak accelerating field that transports the ions far into the ion trap and gives them so much energy that, in the subsequent reverse accelerating high-voltage pulse, which is no longer as high as at the edge of the trap because of the location of the ions in the interior of the trap, they are not thrown back to the end caps.

A capturing RF voltage of this type can comprise individual high voltage pulses which are short compared to the complete period, and which have alternate positive and negative voltage with equally long intervals of low voltage between the high voltage pulses, for example. The high voltage pulses are responsible for the continuous storage of the ions whence captured. Since the field strength, which is generated by the RF voltage within the ion trap, decreases linearly towards the center of the ion trap, a high voltage pulse has only a weak effect on an ion which has penetrated deeply and it can neither force it back to the entrance end cap nor accelerate it to the opposite end cap. Such a special RF voltage consisting of high voltage pulses and low voltage capturing intervals considerably enlarges the capturing yield.

To continue operating the quadrupole ion trap after the filling process, one switches to the normally sinusoidal high voltage. One option is to use a high-voltage-proof vacuum relay which switches between two separate voltage providers. As described in more detail below, the two RF voltages can also be brought together in a different way.

To differentiate between these two RF voltages, the term "capturing RF voltage" is used in the following for the voltage which is applied during the capturing process, and the term "operating RF voltage" is used for the voltage which is applied during the remainder of the time the ion trap is in operation.

The frequency of the capturing RF voltage, in particular, can be different from that of the operating RF voltage. A lower frequency capturing RF voltage accompanied by a reduced injection energy of the ions increases their chances of capture.

As is already known, it is favorable and substance-saving in this case to prestore the ions in an ion guide and to inject them into the quadrupole ion trap by means of an appropriately controlled injection lens only during the capturing interval. In this case, the switchable lens can remain switched on for the complete duration of the capturing process until the trap is completely full; on the other hand, the switchable lens can also be controlled so that the ions are injected in individual short packages only during the favorable capturing intervals. The latter is particularly possible if the frequency of the capturing RF voltage decreases during the storage, and the capturing interval is extended with respect to the RF period, because in the extended capturing interval, the mass discrimination of the injection lens is reduced. Under these operating conditions, the switchable lens can be opened once (or even twice, in the case of two capturing intervals per period) in each period of the capturing RF voltage, or alternatively, if a slower filling is desired, it can be limited to every nth capturing RF period. This enables the filling speed to be reduced. If each RF period is used, the quadrupole ion trap is filled with at least the same speed as if no switching lens were present, since the filling is only interrupted during the times when the ions are otherwise lost.

Feeding in a pulsed surge of collision gas can also improve the capture. This method is technically simple and easy to carry out. The pressure in the ion trap must be increased sufficiently so that noticeable deceleration occurs even when the ion trap is traversed only once. For optimum operation of the quadrupole ion trap as a mass spectrometer, the pressure of the collision gas must decrease again after the filling, as otherwise the resolution will suffer.

BRIEF DESCRIPTION OF THE DRAWINGS

The above and further advantages of the invention may be better understood by referring to the following description in conjunction with the accompanying drawings in which.

DETAILED DESCRIPTION

Figure 1:
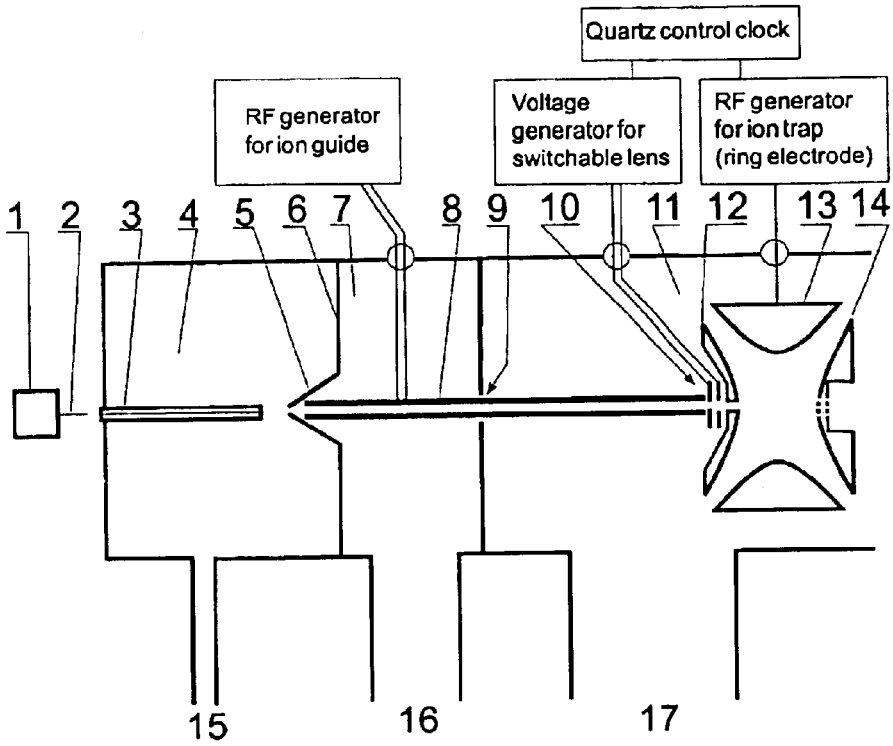
FIG. 1 shows schematically an example of a quadrupole ion trap mass spectrometer used for this invention, with vacuum-external electrospray ion source, switchable ion lens, and RF quadrupole ion trap.

FIG. 1 shows the quadrupole ion trap mass spectrometer with vacuum-external electrospray ion source, switchable ion lens, and RF quadrupole ion trap. The invention should not be limited to electrospray ion sources; ion generation by matrix-assisted laser desorption (MALDI), for example, can also be used. The supply tank (1) contains a liquid which is sprayed by an electric voltage between the fine spray capillary (2) and the front of the inlet capillary (3). The ions, together with ambient air, enter through the inlet capillary (3) into the first chamber (4) of a differential pumping system, chamber (4) being connected to a roughing pump. The ions are accelerated towards the skimmer (5) and pass through the opening in the skimmer (5), located in partition (6), into the second chamber (7) of the differential pumping system. This chamber (7) is connected via connector (16) to a high vacuum pump. The ions are accepted by the RF ion guide (8) and guided through the wall opening (9) and the main vacuum chamber (11) to the end cap (12) of the ion trap. The ion trap consists of two end caps (12, 14) and the ring electrode (13). The main vacuum chamber is connected via connector (17) to a high vacuum pump.

Figure 2:
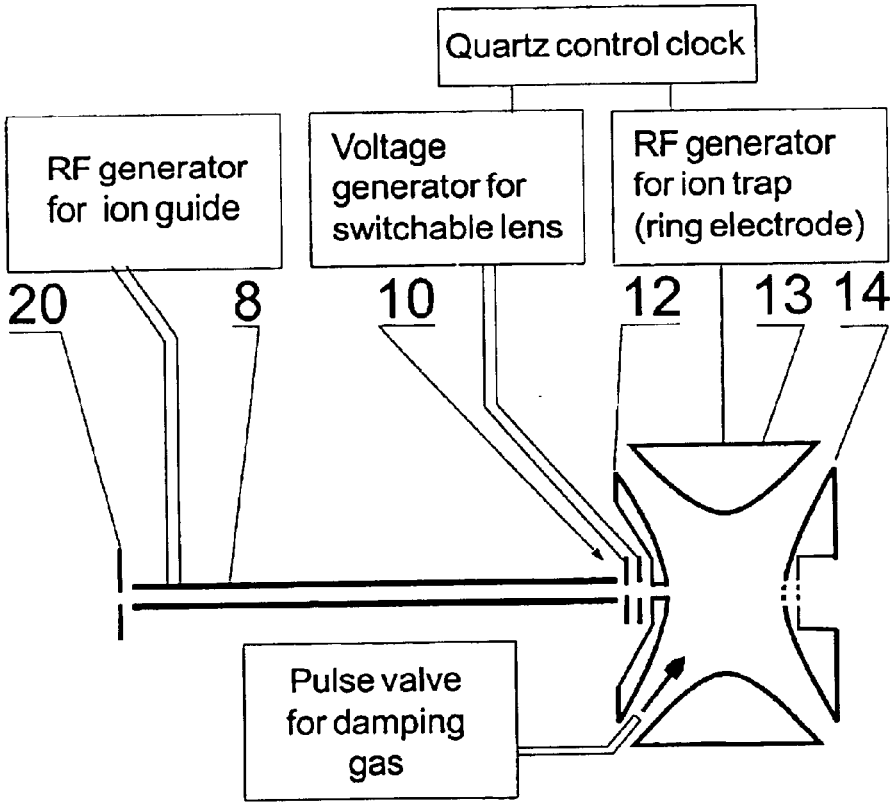
FIG. 2 shows schematically the switchable, three-part ion lens in more detail.

FIG. 2 shows the switchable, three-part ion lens (10) between the RF ion guide (8), which here is set up for the packaging of the ions for the ion injection, and the quadrupole ion trap. The enclosed ions are stored in the RF ion guide (8) by means of an aperture (20) with reflective voltage at the beginning and by the lens (10) at the end. The ion lens (10) consists of two aperture diaphragms and the end cap (12) of the ion trap, which forms the third aperture of an Einzel lens. The lens can be switched to transmission or reflection by means of a voltage on the center electrode of the ion lens (10). The potential of the first aperture of the ion lens (10) is also adjustable; this potential is responsible for the reflection of the ions. The center potential of the RF ion guide (8) has a value which lies between a few tenths of a volt and a few volts above that of the end cap (12) to permit the ions to reach the ion trap at all as they pass through the lens. Pulsed feeding of a collision gas from a gas source into the quadrupole ion trap (12, 13, 14) improves the capturing process even more. The capturing interval then becomes broader, and the ion lens must correspondingly also be switched to transmission for a longer period.

Figure 3:
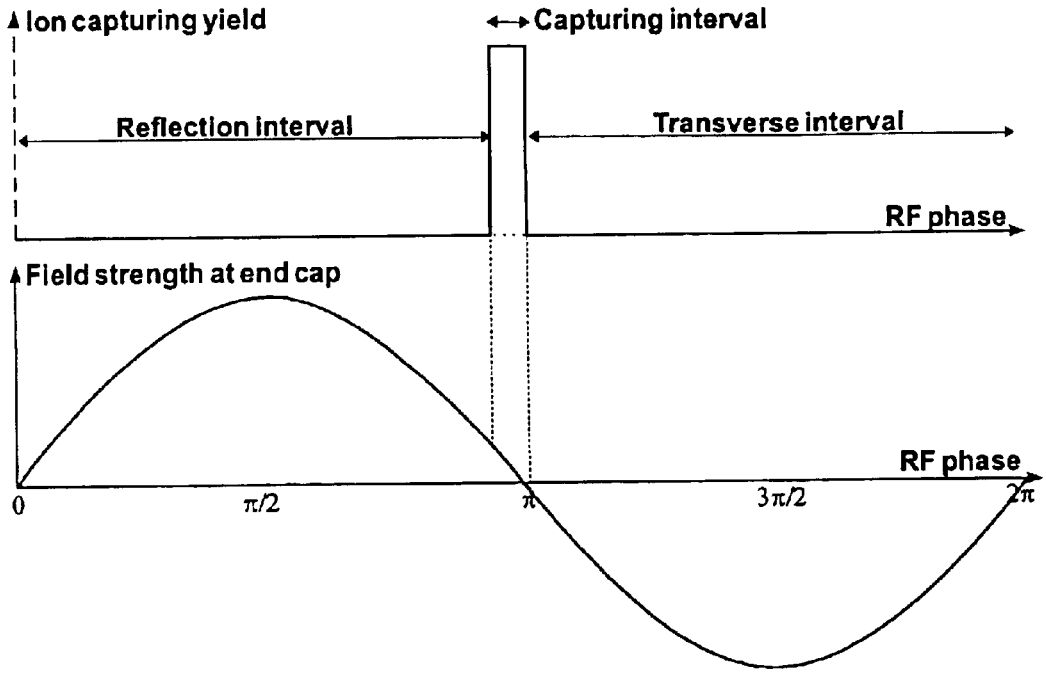
FIG. 3 shows graphically the window of the ion capturing interval within the RF period according to prior art.

FIG. 3 shows a conventional interval of ion capture. At the top is the ion capture yield, superimposed on the phase of the RF voltage; at the bottom is the momentary voltage of the RF. The capturing interval for ions is only a few angular degrees of the complete period. The RF voltage is represented in such a way that it corresponds to the electric field at the end cap electrode. In the first half period from 0 to $\pi$ there is an opposing field for positive ions; the opposing field is located in the ion trap at the point where the injection takes place. Ions which are injected into the quadrupole ion trap with a low initial energy are most easily trapped if, after entering the ion trap, they experience only a very weak, further decreasing opposing field which slows them down. The deceleration is most favorable when the ion comes to rest at exactly the same time as the RF voltage, and hence the opposing field as well, is at the zero crossover. The ions must therefore be injected slightly before the zero crossover. In this case they are captured even without the presence of a collision gas, but then they are permanently oscillating with a large amplitude.

For ions with a slightly higher initial energy, the capturing interval is shifted towards slightly earlier phase values, but is also narrower. The capturing interval can therefore be artificially broadened by first injecting ions with slightly higher kinetic energy and then those with lower energy. At frequencies of around one megahertz this is technically difficult to achieve.

An increased collision gas pressure also broadens the capturing interval a little and shifts the end of the interval past the value $\pi$. The illustrated capturing interval from $0.95\pi$ to $1.01\pi$ is valid for ions with an energy of around 0.5 to 1 eV and for a normal collision gas pressure (in the order of $10^{-4}$ to $10^{-3}$ millibar), as is required to operate a quadrupole ion trap as a mass spectrometer.

Figure 4:
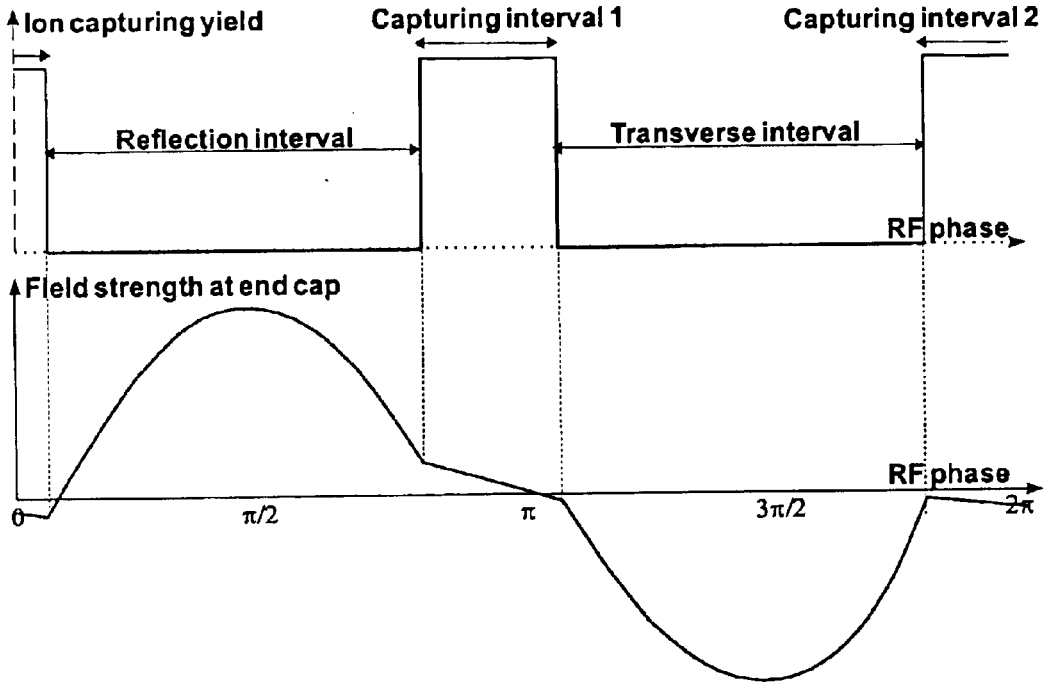
FIG. 4 shows graphically an improved ion capturing according to this invention with an extended interval for the ion capturing by distorting the shape of the RF voltage characteristic, which is no longer a sinusoidal voltage.

FIG. 4 shows an improved ion capture according to this invention with an extended interval for the ion capture achieved by means of a relatively slight distortion of the shape of the characteristic of the RF voltage, which is now no longer sinusoidal. The period with lower opposing voltage for the ions is arbitrarily somewhat extended. Within the RF period, it is even possible to open a second capturing interval. To do this, it is favorable if the penetrating ions are initially accelerated a short way into the ion trap before they encounter the restoring pulse. The duration of this slight acceleration of the ions into the trap can also be increased, so that ions which penetrate late also have the chance of not being forced back to the entrance end cap by the subsequent restoring high voltage pulse. The two low-voltage capturing periods already amount to around one quarter of the total high voltage period here, and the voltages in these capturing periods are considerably lower than one fifth of the peak voltage.

Figure 5:
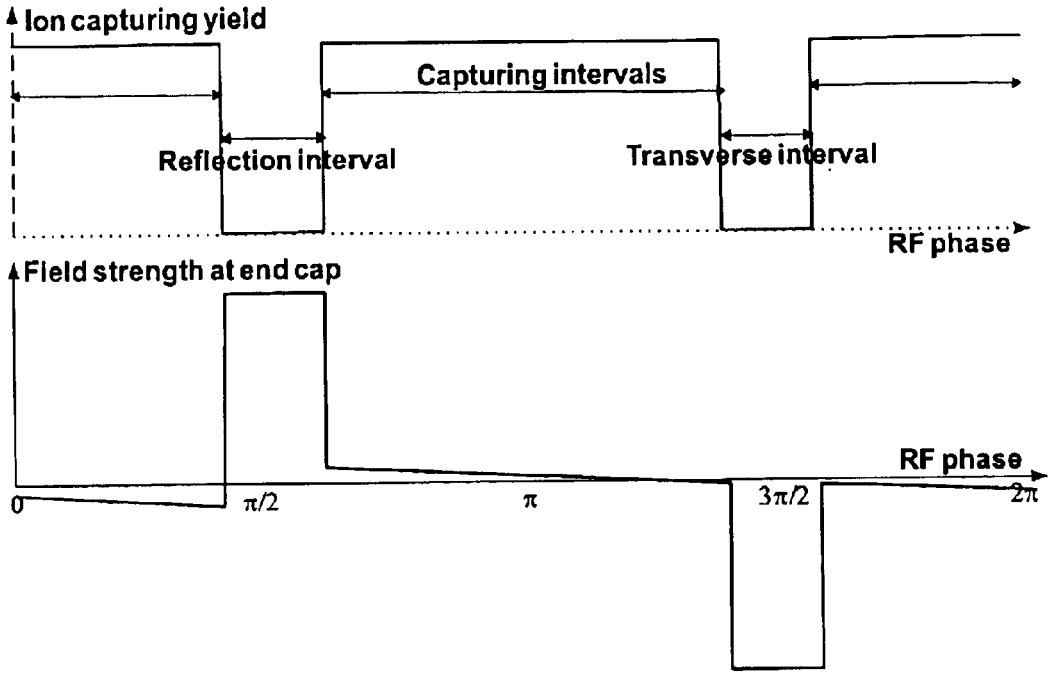
FIG. 5 represents graphically a preferred embodiment of this invention with a pulsed RF voltage which still possesses decelerating and accelerating residual voltages between the positive and negative voltage pulses respectively.

FIG. 5 represents another embodiment of this invention with a pulsed RF voltage which still possesses decelerating and accelerating residual voltages between the positive and negative voltage pulses respectively. Here, the capturing intervals amount to around three quarters of the total RF period. It should be noted that not all ions which are injected during the capturing intervals are actually captured. For continuous injection of the ions, it is, however, possible to increase the capture to around 50 percent of the injected ions, especially if a collision gas is also used. The yield can be increased slightly again by using a switched injection lens, especially if the frequency of the capturing RF voltage is decreased compared with an operating RF voltage of around one megahertz, as is usually used. The capturing voltage can be very low; as a rule, a favorable capturing voltage is less than five percent of the capturing RF peak voltage.

Figure 6:
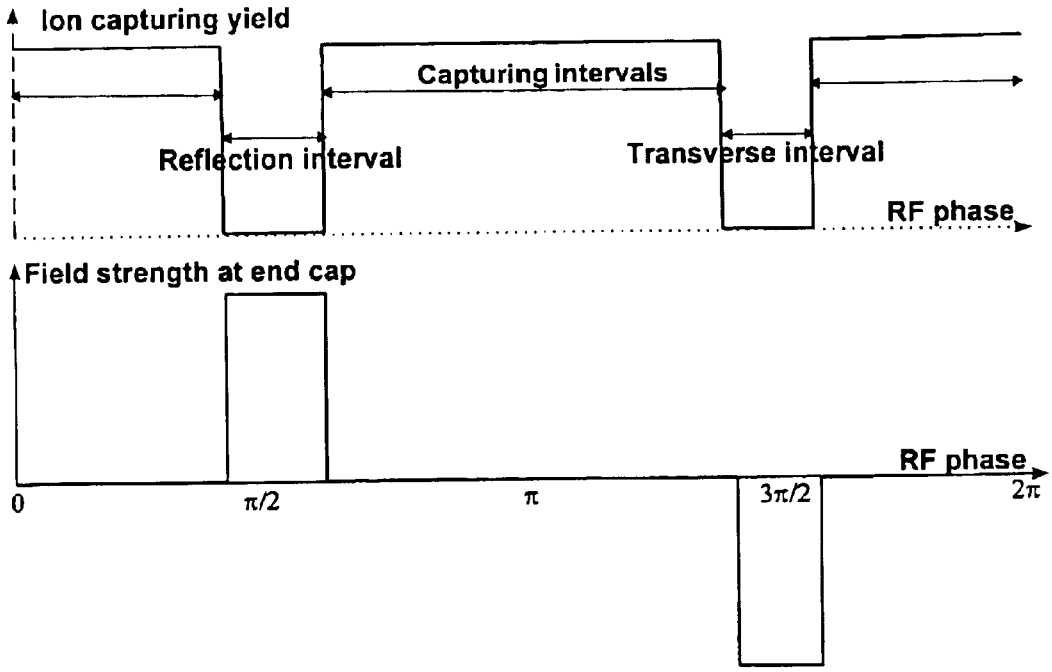
FIG. 6 shows graphically a simplified embodiment of the ion capture according to this invention, with positive and negative high voltage pulses, in between which the ion trap is completely without voltage for some time.

FIG. 6 shows a simplified embodiment of an ion capture according to this invention, with positive and negative high voltage pulses between which the interior of the ion trap is without any voltage for some time. This form of capturing RF is electronically simple to set up and still provides relatively good capturing results, especially when a switched injection lens is used.

Figure 7:
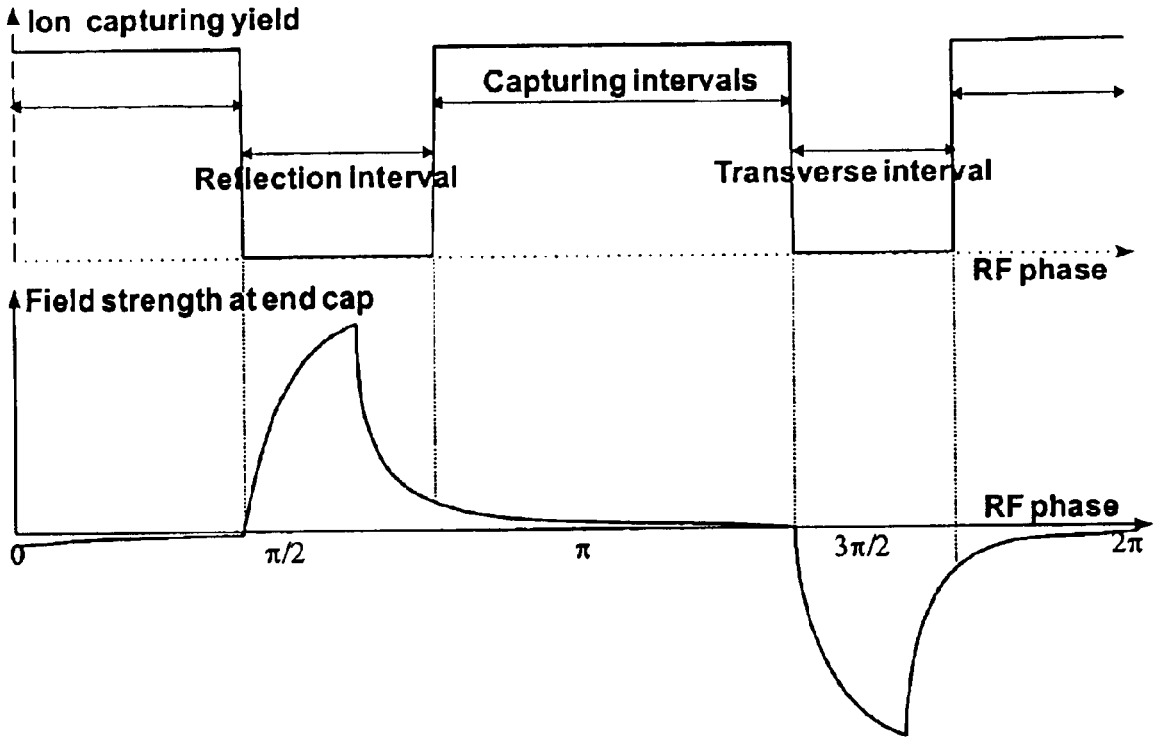
FIG. 7 shows graphically a further embodiment, wherein the positive and negative pulses are fed through the secondary coil of the RF transformer such that they are rounded by the inductance of the coil and automatically form a favorable capturing voltage characteristic in the capturing interval.

FIG. 7 shows another embodiment in which the capturing RF switching is not generated by an electrically separate voltage generator after switching from the operating RF voltage, but instead is additionally fed into the circuit of the secondary coil. A voltage supplier for square pulses of the order of around plus/minus 1000 to 2000 Volts can be incorporated at the grounded end of the secondary coil of the RF transformer. In such cases, the voltage pulses are generated directly by commercial high-voltage transistors. If no operating RF is fed in via the primary coil, then this pulser can operate. The pulses at the ion trap's ring electrode are strongly rounded by the inductance of the secondary coil, however, creating an exponential transition to the desired state, either voltage or no-voltage. This transition automatically generates a favorable capturing behavior of this voltage, as can be seen by comparing FIGS. 5 and 7. This pulse sequence can have a slower frequency for the capture, its frequency then initially being adjusted to match the frequency and phase of the operating RF during the transition to the operating RF, after which the pulse voltage is switched off and the operating RF voltage is switched on.

An ion trap mass spectrometer is only filled with ions for a period of between 10 microseconds and a maximum of 100 milliseconds, as a rule. There then follows a damping period of a few milliseconds in which the ions are collected in a small cloud at the center of the ion trap by slowing down their oscillations. If a normal mass spectrum is to be recorded, there is then an operating period during which the ions are ejected from the ion trap, mass after mass, and measured with a measuring device. The ejection occurs, as a rule, via the end cap (14) of the ion trap, which is located opposite the injection end cap (12). For other types of operation, for example MS/MS, further operating periods of the ion isolation and fragmentation are inserted. As a rule, the filling time is thus short compared with the sum of the other operating periods. The ions generated in the ion source during this operating period can be collected in the temporary store. According to the prior art, most of the ions were lost during the filling of the quadrupole ion trap because the capturing period was very short compared with the complete RF period. This invention makes it possible to largely save these ions from destruction and to use them for the analysis.

FIG. 1 shows the use of an electrospray ion source (1, 2) outside the vacuum housing of the mass spectrometer, although the invention is not limited to this type of ion generation. The ions are extracted in an electrospray ion source (1) by spraying fine drops of a liquid in air (or nitrogen) out of a fine capillary (2) in a strong electric field, causing the drops to evaporate and leave their charge on the detached molecules of the analytical substance. It is thus possible to ionize very large molecules easily.

The ions from this ion source are usually introduced into the vacuum of the mass spectrometer via a capillary (3) with an internal diameter of around 0.5 millimeters and a length of around 100 to 200 millimeters. They are entrained by gas friction with the air (or other gas which is fed into the environment of the entrance) which flows in at the same time. A differential pump with two intermediate stages (4 and 7) is used to evacuate the resulting gas. The ions entering through the capillary are accelerated in the first chamber (4) of the differential pump in the adiabatically expanding gas jet and drawn by an electric field towards the opening of a gas skimmer (5) located opposite. The gas skimmer (5) is a conical tip with a central hole; the external wall of the cone deflects the incident gas outwards. The opening of the gas skimmer guides the ions, which now have much less companion gas, into the second chamber (7) of the differential pump.

The ion guide (8) begins immediately behind the opening of the skimmer (5). This ion guide preferably consists of a linear hexapole array comprising six thin, straight rods arranged uniformly on the circumference of a cylinder. It is, however, also possible to use a curved ion guide with curved pole rods, for particularly good elimination of neutral gas, for example. An RF voltage is supplied to the rods, the phase changing between adjacent neighboring rods. The rods are attached at several places by insulating devices.

A favorable embodiment has rods 100 millimeters in length with a diameter of one millimeter, the enclosed cylindrical guiding compartment has a diameter of 2.5 millimeters. The ion guide is therefore very slim. Experience shows that the ions which enter through a skimmer hole 1.2 millimeters in diameter are accepted by this ion guide practically loss-free if their mass lies above the cutoff limit. This exceptionally good acceptance rate is mainly due to the gas-dynamic conditions at the entrance opening.

At a frequency of around 4 megahertz and a voltage of around 300 volts, all singly charged ions with masses above 30 atomic mass units are focused in the ion guide. Lighter ions leave the ion guide. Using higher voltages or lower frequencies, the cutoff limit for the ion masses can be increased to any value.

The ion guide (8) runs, in this example, from the opening in the gas skimmer (5), which is arranged as part of the wall (6) between first (4) and second chamber (7), through this second chamber (7) of the differential pump, then through a wall opening (9) into the vacuum chamber (11) of the mass spectrometer to the ion switch lens (10), which is located in front of the entrance of the ion trap in the end cap (12). The slim design of the ion guide means that the wall opening (9) can be kept very small, enabling the pressure difference to be kept favorably large. The first aperture of the ion switch lens (10) serves here as first ion reflector, the other ion reflector is formed by the gas skimmer (5) with its opening of 1.2 millimeters diameter.

By changing either the potential on the axis or the mid-potential of the ion guide (8) with respect to the potentials of the skimmer (5) and the first aperture of the ion switch lens (10), the ion guide (8) can be used as a storage device for ions of the same polarity, i.e., for either positive or negative ions. The potential on the axis is identical to the zero potential of the RF voltage on the RF ion guide. The stored ions continuously sweep backwards and forwards in the ion guide (8). Since they acquire a velocity of around 500 to 1000 meters per second or more in the adiabatic acceleration phase of the gas expansion, they initially sweep the length of the ion guide several times a millisecond. Their radial oscillation in the ion guide depends on the angle of injection.

However, since the ions periodically return to the second chamber (7) of the differential pump, where the pressure is around $10^{-3}$ millibars, the radial oscillations are very quickly damped, and the ions collect on the axis of the ion guide. Their longitudinal motion is also slowed to thermal velocities. After a short time the ions therefore possess a thermal velocity distribution, on which is imposed a common velocity component in the direction of the ion trap (12, 13, 14), which arises from the flow of gas molecules.

The ions decelerated to thermal energies fill a fine, string-shaped region on the axis of the rod system of the RF ion guide (8). As a rule, they are reflected on both sides, on the side towards the quadrupole ion trap by the ion lens (10). In order to fill the ion trap the ion lens is switched to transmission; it is therefore not necessary to change the mid-potential of the ion guide.

Before the quadrupole ion trap is filled, the potential of the middle lens aperture is set so that the ions are reflected, while at the same time penetrating as far as possible into the ion puller lens. This reduces the transfer distance. At a pre-determined time before the beginning of the capturing interval, the middle aperture of the ion lens is switched to a high suction potential of several hundred volts. This collects the ions from the area in front of the lens and accelerates them towards the opening of the ion trap. The transfer path into the ion trap should be as short as possible, if possible only about one millimeter. Nevertheless, the ions require a finite time of the order of 100 nanoseconds to traverse the path. This period of time also depends on the mass. The lens must therefore be opened this length of time before the beginning of the capturing interval. It is therefore favorable to make the capturing interval as long as possible.

As the ions pass through the opening in the end cap (12) they are decelerated by the potential of the end cap (12). Their energy after entering corresponds to the potential difference between the mid-potential of the RF ion guide (8) and that of the end cap (12).

The capturing interval for the ions begins when the voltage of the restoring voltage pulse is reduced to a few volts deceleration voltage, or when the voltage of the propelling pulse is reduced to a few volts accelerating voltage. After a restoring voltage pulse the ions are decelerated and at the beginning of the next pulse they are roughly at rest. They are therefore trapped. After a propelling pulse they are initially accelerated into the trap, where they then experience a restoring pulse which almost brings them to rest. They are now similarly trapped. The decelerating or accelerating residual voltages amount to only a few volts in each case; in any case they amount to less than 20 percent, normally to even less than one percent of the peak voltage of the high voltage pulses. The widths of the pulses taken together should be less than three quarters, preferably less than one quarter of the total RF period.

The embodiment described here assumes ions which are formed out-of-vacuum. It is, of course, possible to connect ion sources located within the vacuum housing of the mass spectrometer to ion traps via storing ion guides.

The RF quadrupole ion traps do not necessarily have to take the form of a mass spectrometer themselves. They can, for example, serve to collect ions for time-of-flight spectrometers, to concentrate them to a dense cloud and to then put them into the flight path of the time-of-flight spectrometer by pulsed injection. This also makes it possible to first isolate, or also to fragment, certain desired ions in the ion trap in the normal way before the ions are pulse injected; this produces MS/MS measurements in time-of-flight spectrometers.

What is claimed is:

1. Method for the cyclic operation of a quadrupole ion trap mass spectrometer comprising the steps of:

(a) filling the ion trap with injected ions by using a capturing RF consisting of extended capturing intervals of low capturing voltage between high voltage pulses of alternating polarity within each RF period; and (b) operating the ion trap mass spectrometer after filling with ions with a sinusoidal RF voltage.

2. Method according to claim 1, wherein the capturing intervals of low capturing voltage taken together cover at least a quarter of the capturing RF period, and the low capturing voltage amounts at maximum to a fifth of the peak voltage of the high voltage pulses.

3. Method according to claim 1, wherein the capturing intervals of low capturing voltage taken together cover at least three quarters of the capturing RF period, and the low capturing voltage amounts at maximum to five percent of the peak voltage of the high voltage pulses.

4. Method according to claim 1, wherein the capturing RF for the duration of the filling process has a different frequency to the operating RF for the remaining operating of the quadrupole ion trap.

5. Method according to claim 1, wherein the intervals of low capturing voltage in the capturing RF voltage have practically no voltage.

6. Method according to claim 1, wherein the capturing RF voltage consists of pulses whose pulse width is narrow compared to the complete capturing RF period.

7. Method according to claim 1, wherein a switchable ion lens injects the ions into the ion trap.

8. Method according to claim 1, wherein the ion capture is improved by the pulsed feeding of collision gas.

9. Quadrupole ion trap mass spectrometer comprising:

(a) an RF voltage generator for the operation of the ion trap outside the filling periods; and (b) an RF voltage generator for the capturing process of injected ions, the capturing RF voltage possessing relatively protracted low-voltage intervals measured against the length of the capturing RF period.

10. Quadrupole ion trap mass spectrometer according to claim 9, additionally comprising a switchable injection lens, and a voltage supply for the injection lens can switch the voltage in synchronization with the capturing RF voltage.

11. Quadrupole ion trap mass spectrometer according to claim 10, wherein the voltage supply for the switching of the ion lens has a rise time of at least 1000 volts per microsecond.

12. Quadrupole ion trap mass spectrometer according to claim 10, wherein the phase of the switching of the ion lens can be adjusted against the phase of the capturing RF, and the duration of the switching can also be adjusted.

* * * * *